US008522684B2

(12) United States Patent
Davies et al.

(10) Patent No.: US 8,522,684 B2
(45) Date of Patent: Sep. 3, 2013

(54) CARTRIDGE CASES AND BASE INSERTS THEREFOR

(75) Inventors: Jack D Davies, Houma, LA (US); Gregory J Biederman, Manchester, NH (US); Christopher A Coco, Salem, NH (US)

(73) Assignee: Nylon Corporation of America, Inc., Manchester, NH (US)

( * ) Notice: Subject to any disclaimer, the term of this patent is extended or adjusted under 35 U.S.C. 154(b) by 0 days.

(21) Appl. No.: 13/224,590

(22) Filed: Sep. 2, 2011

(65) Prior Publication Data

US 2012/0060716 A1 Mar. 15, 2012

Related U.S. Application Data

(60) Provisional application No. 61/381,609, filed on Sep. 10, 2010.

(51) Int. Cl.
*F42B 5/26* (2006.01)

(52) U.S. Cl.
USPC ..... 102/469; 102/470; 102/466; 102/467

(58) Field of Classification Search
USPC ..... 102/464, 465, 466, 467, 468, 469, 102/470
See application file for complete search history.

(56) References Cited

U.S. PATENT DOCUMENTS

| | | | | |
|---|---|---|---|---|
| 590,428 | A | 9/1897 | Bennett | |
| 905,358 | A * | 12/1908 | Peters | 102/470 |
| 3,797,396 | A | 3/1974 | Reed | |
| 4,041,868 | A * | 8/1977 | Rayle et al. | 102/468 |
| 4,147,107 | A | 4/1979 | Ringdal | |
| 4,478,150 | A | 10/1984 | Sayler et al. | |
| 4,614,157 | A | 9/1986 | Grelle et al. | |
| 4,738,202 | A * | 4/1988 | Hebert | 102/467 |
| 5,272,983 | A | 12/1993 | Sippel et al. | |
| 5,563,365 | A | 10/1996 | Dineen et al. | |
| 6,752,084 | B1 | 6/2004 | Husseini et al. | |
| 7,213,519 | B2 | 5/2007 | Wiley et al. | |
| 8,156,870 | B2 * | 4/2012 | South | 102/469 |
| 2005/0115446 | A1 * | 6/2005 | Heitmann et al. | 102/469 |
| 2007/0214992 | A1 * | 9/2007 | Dittrich | 102/469 |
| 2011/0179965 | A1 * | 7/2011 | Mason | 102/467 |
| 2011/0214583 | A1 * | 9/2011 | Dutch | 102/464 |

* cited by examiner

*Primary Examiner* — James Bergin
(74) *Attorney, Agent, or Firm* — Renner Kenner Greive Bobak Taylor Weber

(57) ABSTRACT

A base insert for a cartridge case comprises a base end having a lip and a groove proximate the lip and having a primer pocket defined in the base end and an insert end having a base wall and a cylindrical wall extending there from, the base wall and cylindrical wall defining a powder fill pocket. The base wall has a flash hole disposed therein and an inner surface facing the powder fill pocket. The cylindrical wall has an inner surface intersecting with the inner surface of the base wall and an outer surface defining the outer circumference of the base insert. The intersection of the inner surface of the base wall and the inner surface of the cylindrical wall is curved or forms an oblique angle, while the outer surface of the insert end is not curved and does not form an oblique angle.

3 Claims, 8 Drawing Sheets

CARTRIDGE CASES AND BASE INSERTS THEREFOR

CROSS-REFERENCE TO RELATED APPLICATIONS

This application is a non-provisional application and claims the benefit of U.S. Provisional Patent Application Ser. No. 61/381,609, filed Sep. 10, 2010, now abandoned.

TECHNICAL FIELD

The present invention relates to the munitions arts. More particularly, the present invention relates to cartridge cases and base inserts therefor.

BACKGROUND

In the munitions arts, a cartridge includes a case, a bullet, propellant, and a primer. Such cartridges are used in firearms and the operation of such cartridges is generally well known in the art. To discharge a cartridge in a firearm, a user typically squeezes a trigger to activate a firing pin and the firing pin strikes the primer, causing the propellant to ignite. The ignited propellant creates substantial pressure within the cartridge, and the bullet is forcefully ejected from the cartridge and from the firearm.

A cartridge case generally extends between two ends, a base end and a forward end. The base end is generally closed and includes features for receiving the primer. The forward end is generally open, with the bullet being inserted into this forward open end of the cartridge case. A volume is defined within the cartridge case between the base end and the forward end, and the propellant is contained within that volume. Modern cartridges use so-called "smokeless powder" as the propellant, and for the purposes of this disclosure, the volume where the propellant is contained will be called the powder fill pocket. The cartridge case also includes a generally tubular outer wall having a generally constant diameter, and a web that extends transverse to the outer wall proximate the base end. A primer pocket is formed between the web and the base end and a flash hole connects the primer pocket with the powder fill pocket.

The exterior of a cartridge case can take on any suitable shape. Known cartridge cases have bases with several different profiles. Proximate the base end, cartridge cases are generally cylindrical in shape. When viewed in the cross section taken along the diameter and showing the length axis of a cartridge case, the outer wall has a generally constant diameter, except for near the base end. Proximate the base end structures such as rims, extraction grooves and belts may be found. In one known example, the diameter of the cartridge case is smaller than a rim positioned at the base end of the cartridge case. Such a design is referred to in the art as a rimmed cartridge case. In another known cartridge case design, the outer wall of the cartridge case tapers radially inwardly to form an extraction groove proximate the base end, and the extraction groove includes a lip that does not extend beyond the diameter of the outer wall. Such design is known in the art as a rimless cartridge case because the lip of the extraction groove does not extend beyond the outer wall. Such is different from the rim of the rimmed design, which extends beyond the diameter of the outer wall. In yet another cartridge case design, the outer wall of the cartridge case tapers near the base end to define an extraction groove and a lip extends slightly beyond the diameter of the outer wall. Such a design is known as a semi-rimmed cartridge case. In another known cartridge case design, a belt extends radially outwardly from the outer wall proximate the base end, then tapers radially inwardly to define an extraction groove and a lip, much like the extraction groove and lip found in rimless designs. Such a design is known as a belted cartridge case. In yet another cartridge case design, the outer wall tapers radially inwardly near the base end to define a groove, and the groove has a lip that does not extend as far as the diameter of the outer wall. Such a design is known as rebated cartridge case.

SUMMARY OF THE INVENTION

The present invention is generally directed to a cartridge case of the type having a base insert and a case overmolded or otherwise connected thereto. More particularly, the present invention is direct to a base insert for the cartridge case comprising a base end having a lip and a groove proximate the lip and having a primer pocket defined in the base end, and an insert end having a base wall and a cylindrical wall extending there from, said base wall and cylindrical wall defining a powder fill pocket. The base wall has a flash hole disposed therein and an inner surface facing the powder fill pocket. The cylindrical wall has an inner surface intersecting with the inner surface of the base wall and an outer surface defining the outer circumference of the base insert. The intersection of the inner surface of the base wall and the inner surface of the cylindrical wall is curved, while the outer surface of the insert end is not curved.

A further aspect of the present invention may include the inner surface of the base wall being substantially orthogonal to the outer surface of the cylindrical wall, while the inner surface of the cylindrical wall in substantially parallel to the cylindrical wall. Alternatively, the inner surface of the base wall may be substantially orthogonal to the outer surface of the cylindrical wall, while the inner surface of the cylindrical wall is substantially slanted and not parallel to the cylindrical wall. In one embodiment, the cylindrical wall has a tapering thickness, wherein the cylindrical wall is thicker proximate its intersection with the base wall and thinner distal from the base wall. In another embodiment, the inner surface of the base wall includes a curved cut-out contiguous with the curvature of the intersection of the inner surface of the base wall and the inner surface of the cylindrical wall. Still further, another embodiment may provide that the inner surface of base wall include a curved cut-out adjacent to and surrounding the flash hole. Yet another embodiment may combine both the curved cut-out adjacent to and surrounding the flash hole with the curved cut-out contiguous with the curvature of the intersection of the inner surface of the base wall and the inner surface of the cylindrical wall. Other embodiments provide that the base wall may include an annular flashhole cutoff pit disposed therein.

Another aspect of the present invention may be achieved by a base insert for a cartridge case comprising a base end having a lip and a groove proximate the lip and having a primer pocket defined in the base end, and an insert end having a base wall and a cylindrical wall extending there from, said base wall and cylindrical wall defining a powder fill pocket. The base wall has a flash hole disposed therein and an inner surface facing the powder fill pocket. The cylindrical wall has an inner surface intersecting with the inner surface of the base wall and an outer surface defining the outer circumference of the base insert. The intersection of the inner surface of the base wall and the inner surface of the cylindrical wall forms an oblique angle, while the intersection of the base wall with the outer surface of the of the cylindrical wall does not form an oblique angle.

Another aspect of the present invention may be achieved by a base insert for a cartridge case made from the base insert with a polymer over molded with the base insert, the base insert comprising a cylindrical wall, a first radially indented polymer groove adjacent the cylindrical wall, and a second radially indented polymer groove in the cylindrical wall. An extraction groove is formed in the cartridge case near the first radially indented polymer groove when the polymer is molded over the base insert.

Any one of these aspects of the present invention, as well as potentially other features and advantages of the present invention, will be better understood with regard to the following description of the invention as set forth herein below.

BRIEF DESCRIPTION OF THE DRAWINGS

Any advantages of the present invention will become better understood with regard to the following description, appended claims, and accompanying drawings wherein:

BEST MODES FOR CARRYING OUT THE INVENTION

The concepts of the present invention will be described in the context of a rimless cartridge case, but the teachings contained herein are equally applicable to other designs for cartridge cases, including those described herein. Some embodiments of the present invention relate to components of a cartridge case that includes a metal base insert and a polymer portion.

Figure 15:
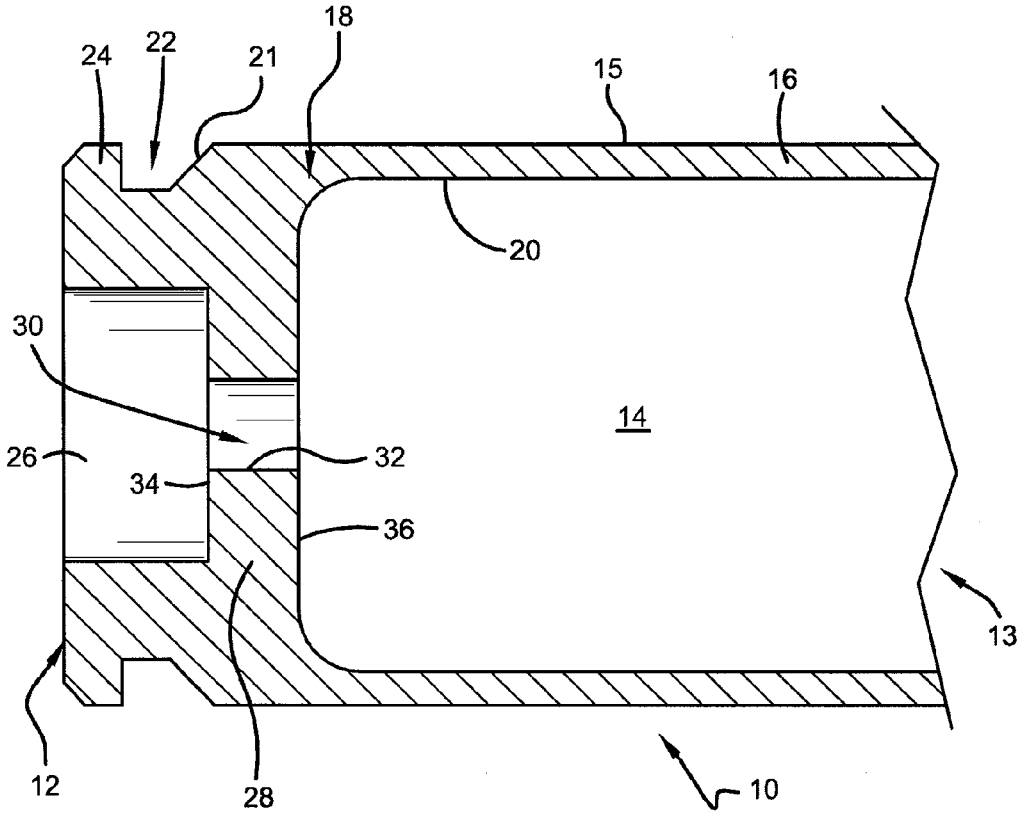
FIG. 15 is a cross section of a portion of a cartridge case.

Turning to FIG. 15, a portion of an exemplary cartridge case is shown and is generally indicated by the numeral 10. In particular, FIG. 15 shows a base end 12 and an insert end 13 defining a portion of a powder fill pocket 14. An outer surface 15 of a cylindrical wall 16 defines the radial outer boundary of a cartridge case body 18 of cartridge case 10. Case body 18 includes an inner wall 20, generally radially defining the powder fill pocket 14. Case body 18 tapers radially inwardly at 21 between the insert end 13 and base end 12 to define an extraction groove 22. Extraction groove 22 has a lip 24 whose diameter is approximately equal to the diameter of outer surface 15 of the cylindrical wall 16. A primer pocket 26 is defined in cartridge case 10 proximate base end 12. Cartridge case 10 includes a transversely extending base wall or web 28 proximate base end 12. A flash hole 30 extends through base wall 28 and connects primer pocket 26 and powder fill pocket 14. As shown in FIG. 15, flash hole 30 is generally cylindrical in shape, and a flash hole wall 32 extends from a primer pocket wall 34 to an inner surface 36 of base wall 28.

A cartridge case can be made from a combination of pieces, any or all of which may be made from metal or plastic materials. In one known arrangement, a metal base insert has a polymer portion molded over it, so that the combined polymer portion and metal base insert constitute the cartridge case. In any event, such cartridge cases have the same general overall shape as the cartridge case designs that are of unitary construction.

In the present invention, the angle of intersection between the inner surface 20 of the cylindrical wall 16 and inner surface 36 of the base wall 28 is important. Generally, in one embodiment, the thickness of the cylindrical wall tapers in thickness from a thick wall proximate the base wall 28 to a thinner wall distal from the base wall 28. However, the tapering of the wall is set forth on the inside of the cylindrical wall, not the outside. The shape of the flash hole, including the shape of the flash hole wall as it intersects with the base wall is also important. In one embodiment, there may be a curved cut-out 52 surrounding the flash hole 30, such that the flash hole wall 32 is less thick than the base wall 28 in general.

Turning to the figures, shapes of portions of several base inserts used to make cartridge cases will now be described. The figures are cross section views taken along a diameter and show a portion of a base insert, in particular where the base end, the web, and a portion of the outer wall and inner wall of a cartridge case are formed using the base inserts shown in the figures.

Figure 1:
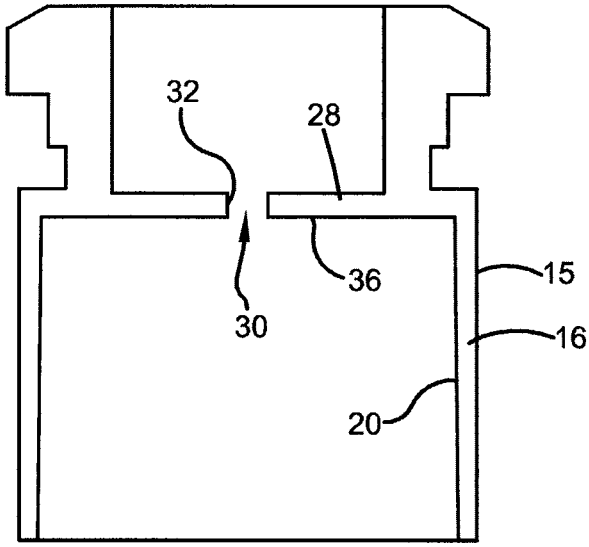
FIG. 1 PRIOR ART
FIG. 1 is a cross section of a portion of a base insert constructed according to the concepts of the present invention.

FIG. 1 shows a prior art base insert where the inner surface 20 of the cylindrical wall 16 is substantially parallel to the outer surface 15 of the cylindrical wall 16, and the base wall 36 extends generally perpendicular or orthogonal to cylindrical wall 16, so that the inner surface 36 of base wall 28 and inner surface 20 of base wall 16 intersect at a right angle. The flash hole 30 and flash hole wall 32 are generally perpendicular to base wall 28 and flash hole wall 32 intersects base wall 36 at approximately a right angle.

Figure 2:
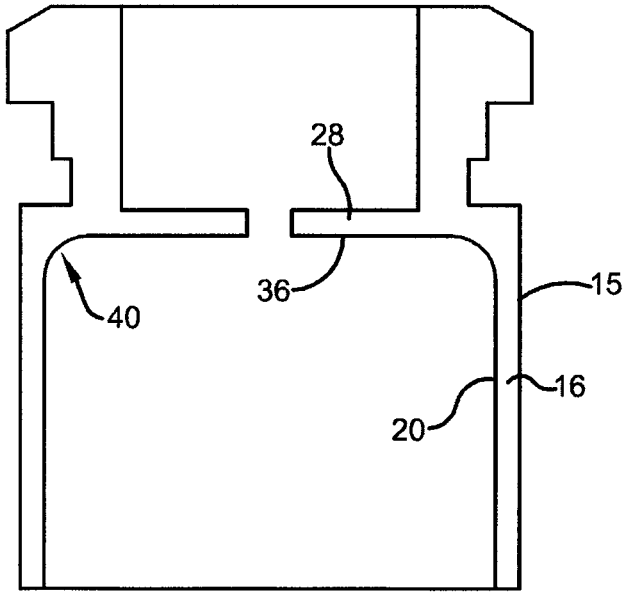
FIG. 2 is a cross section of a portion of another base insert constructed according to the concepts of the present invention.

The base insert of FIG. 2 is substantially similar to the base insert of FIG. 1 in that the inner surface 20 of cylindrical wall 16 is substantially parallel to outer surface 15 of cylindrical wall 16 and inner surface 36 of base wall 28 extends generally perpendicular or orthogonal to cylindrical wall 16. However, in this embodiment, the inner surface 20 of cylindrical wall 16 intersects and connects with the inner surface 36 of base wall 28 through a curved portion 40, while the outer surface 15 of the cylindrical wall 16 is not so curved and does not include such a curved portion.

Figure 3:
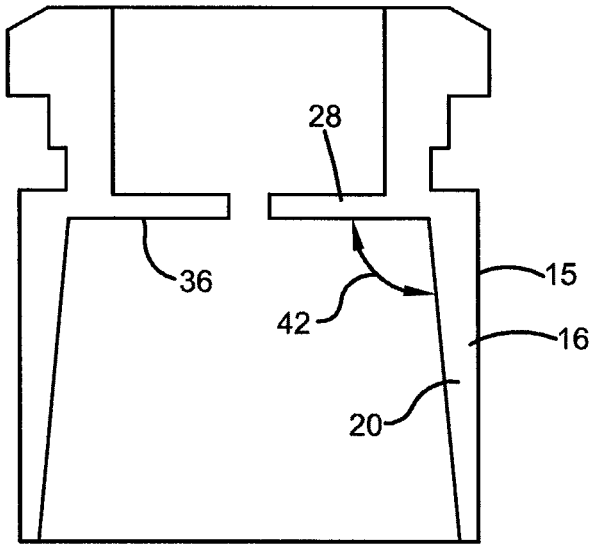
FIG. 3 is a cross section of a portion of yet another base insert constructed according to the concepts of the present invention.

In FIG. 3, a portion of the inner surface 20 of cylindrical wall 16 extends at an angle and is tapered with respect to outer surface 15 of the cylindrical wall 16. Base wall 28 extends generally perpendicular or orthogonal to the outer surface 15 of the cylindrical wall 16, while the inner surface 20 of the cylindrical wall 16 intersects with the inner surface 36 of the base wall 28 at an oblique angle 42.

Figure 4:
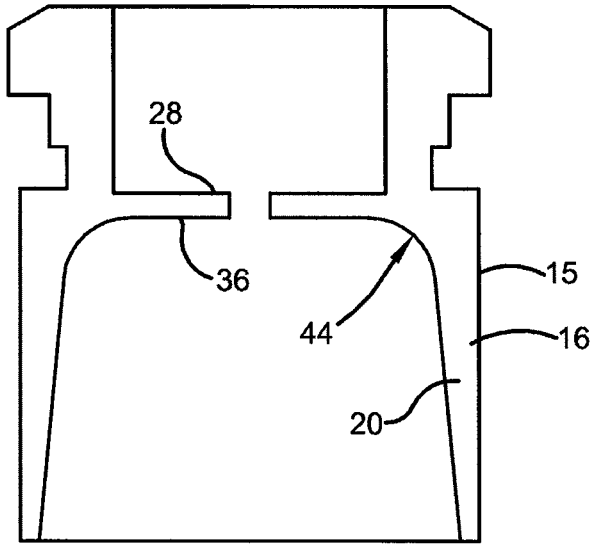
FIG. 4 is a cross section of a portion of yet another base insert constructed according to the concepts of the present invention.

In FIG. 4, the base insert is similar to that in FIG. 3, inasmuch as a portion of inner surface 20 of the cylindrical wall 16 extends at an angle with respect to the outer surface 15 of the cylindrical wall 16, and base wall 28 extends generally perpendicular to the outer surface 15 of the cylindrical wall 16. However, FIG. 4 differs from FIG. 3 in that the inner surface 20 of the cylindrical wall 16 and the inner surface 36 of the base wall 28 intersect and connect through a curved portion 44.

Figure 5:
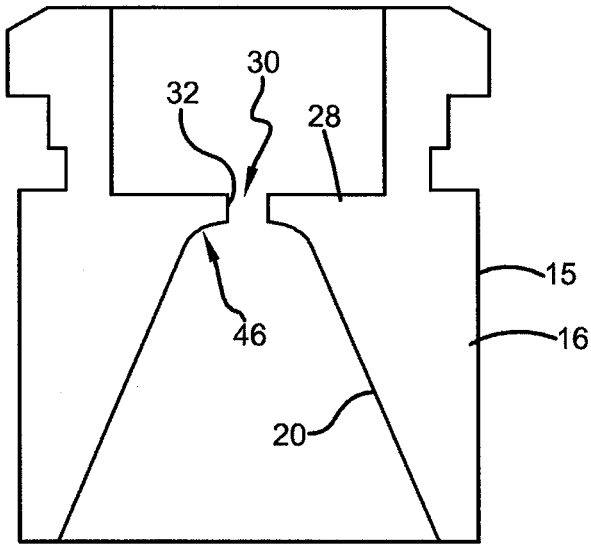
FIG. 5 is a cross section of a portion of yet another base insert constructed according to the concepts of the present invention.

In FIG. 5, the inner surface 20 of cylindrical wall 16 extends at a larger angle with respect to outer surface 15 of cylindrical wall 16 as compared to FIG. 4. Because of this shape, inner surface 36 of base wall 28 is much smaller in length and may be essentially non-existent. Thus, the inner surface 20 of cylindrical wall 16 may be considered to be connected to the flash hole wall 32 of flash hole 30 through a curved region 46.

Figure 6:
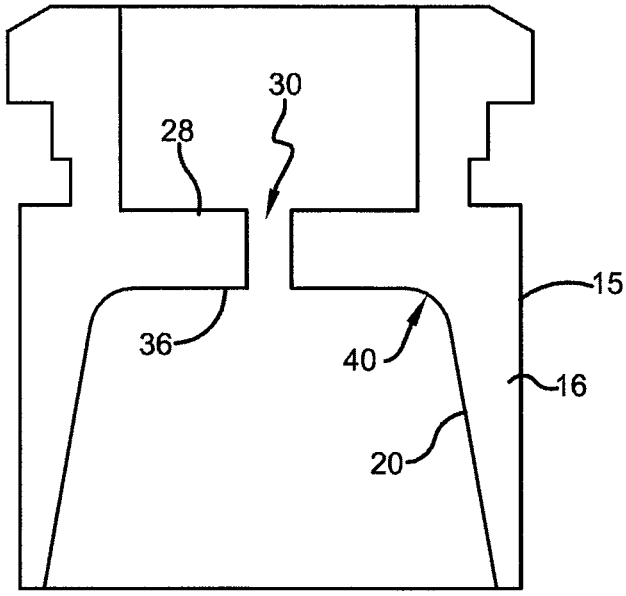
FIG. 6 is a cross section of a portion of yet another base insert constructed according to the concepts of the present invention.

The base insert of FIG. 6 is substantially similar to the base insert of FIG. 4, with the essential difference being the thickness of base wall 28. As a result, the length of flash hole 30 is greater than the length of the flash hole shown in FIGS. 1-5.

Figure 7:
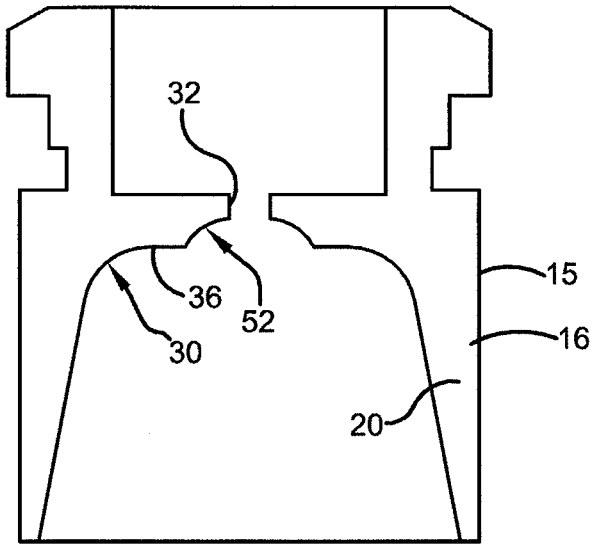
FIG. 7 is a cross section of a portion of yet another base insert constructed according to the concepts of the present invention.

In FIG. 7, a portion of the inner surface 20 of cylindrical wall 16 again extends at an angle with respect to the outer surface 15 of cylindrical wall 16. Inner surface 20 of cylindrical wall 16 intersects and connects to the inner surface 36 of base wall 28 through a curved portion 50. In addition, another curved portion or cut-out 52 in base wall 28 surrounds and is adjacent to flash hole 30 such that flash hole wall 32 is shorter than in previous designs, i.e., where the flash hole would extend to in the absence of curved portion or cut-out 52.

Figure 8:
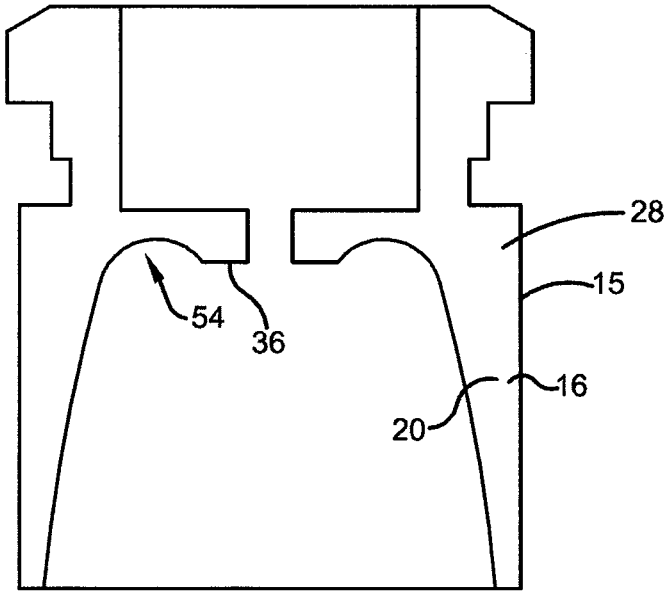
FIG. 8 is a cross section of a portion of yet another base insert constructed according to the concepts of the present invention.

In FIG. 8, a portion of the inner surface 20 of cylindrical wall 16 again extends at an angle with respect to the outer surface 15 of cylindrical wall 16. Moreover, the inner surface 36 of base wall 28 extends generally perpendicular or orthogonal to the outer surface 15 of cylindrical wall 16. Further, the inner surface 20 of cylindrical wall 16 intersects and connects with base wall 28 through a curved portion 54. However, the curved portion 54 extends beyond and cuts out a portion of the inner surface 36 of the base wall 28. Thus, the curved portion 54 is contiguous with the curved intersection of the inner surface 36 of base wall 28 and inner surface 20 of cylindrical wall 16

Figure 9:
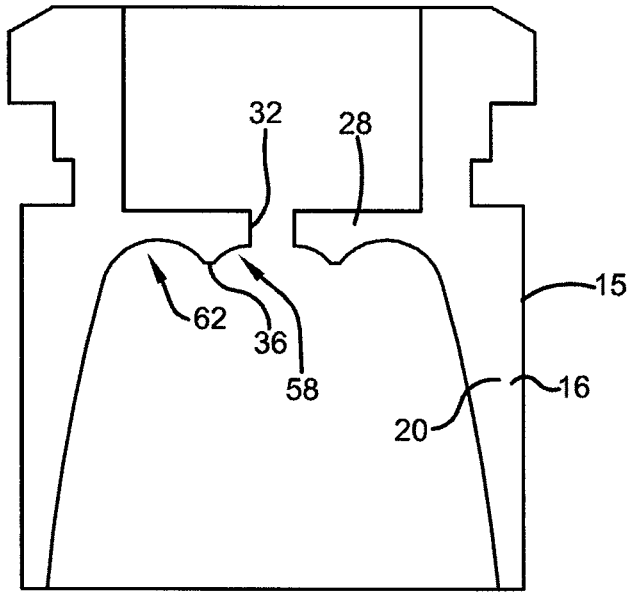
FIG. 9 is a cross section of a portion of yet another base insert constructed according to the concepts of the present invention.

In FIG. 9, the contiguous curved intersection shown in FIG. 8 and the curved portion surrounding and adjacent the flash hole are shown in combination. That is, a portion of inner surface 20 of cylindrical wall 16 again extends at an angle with respect to outer surface 15 of cylindrical wall 16. Flash hole wall 32 is connected to inner surface 20 through an inner surface of base wall 28 having two intermediate curved portions, 58 and 62. The first curved portion 58 surrounds and is adjacent to the flash hole wall 32. The curvature ends at a point 60, and the second curved portion 62 begins and extends from the point 60 to cut out a portion of base wall 28 and is formed contiguously with the curve formation at the intersection of the inner surface of the cylindrical wall 16 and the inner surface of the base wall 28.

Figure 10:
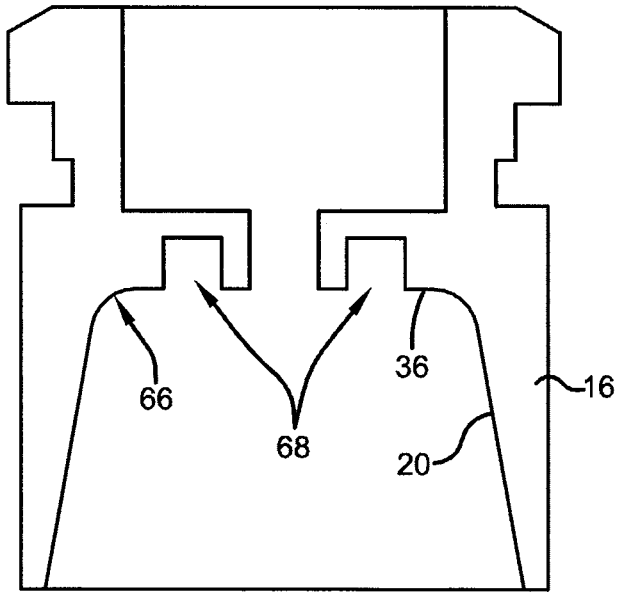
FIG. 10 is a cross section of a portion of yet another base insert constructed according to the concepts of the present invention.

In FIG. 10, a portion of the inner surface 20 of cylindrical wall 16 again extends at an angle with respect to the outer surface 15 of cylindrical wall 16. Further, base wall 28 extends generally perpendicular to outer wall 16. The inner surface 20 of the cylindrical wall 16 intersects and connects with the inner surface 36 of base wall 28 through a curved portion 66. In addition, an annular flashhole cutoff pit 68 is defined in base wall 28 radially inside curved portion 66. As shown, base wall 28 is interrupted by flashhole cutoff pit 68, so that a portion of base wall 28 extends both radially inside and outside of flashhole cutoff pit 68.

In the case where the cartridge cases are made from a base insert with a polymer over molded with the base insert, the base insert can have different profile configurations proximate the base end 12. Turning to FIGS. 11-14, four examples are shown.

Figure 11:
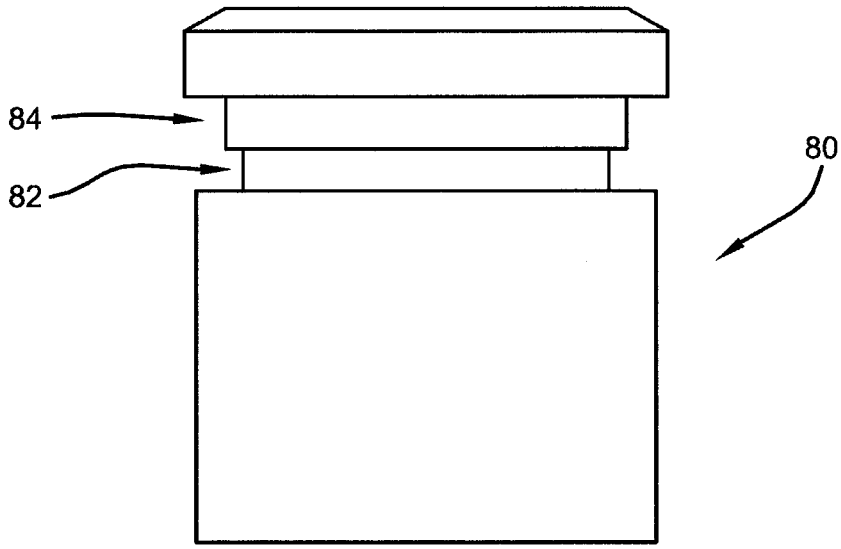
FIG. 11 is a side elevation view of a portion of a base insert constructed according to the concepts of the present invention.

In FIG. 11, a standard insert 80 shown. The standard insert 80 includes a radially indented polymer groove 82. Once the polymer is molded over insert 80, an extraction groove is formed in the area near 84.

Figure 12:
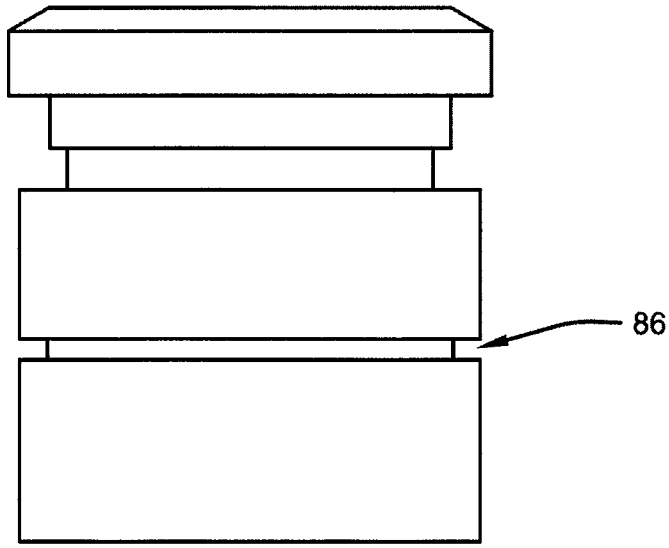
FIG. 12 is a side elevation view of a portion of another base insert constructed according to the concepts of the present invention.

The insert of FIG. 12 is substantially similar to what is shown in FIG. 11, but also includes a second polymer groove 86 formed in the outer wall.

Figure 13:
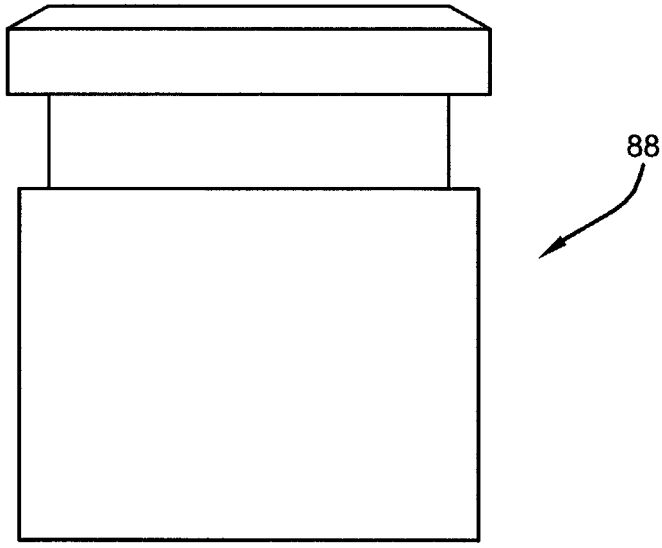
FIG. 13 is a side elevation view of a portion of yet another base insert constructed according to the concepts of the present invention.

FIG. 13 shows a metal base insert having a polymer fill groove 88 with a similar diameter through where the extractor groove.

Figure 14:
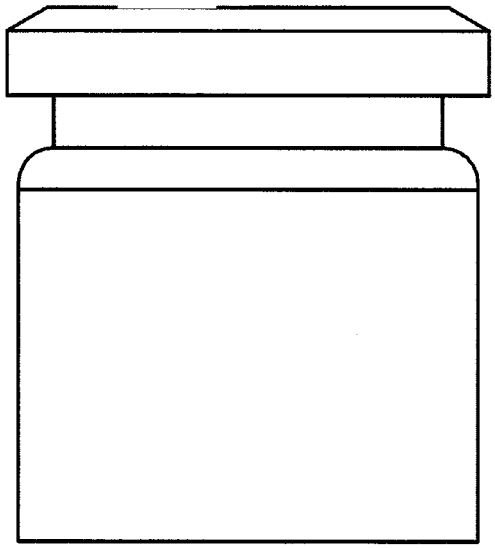
FIG. 14 is a side elevation view of a portion of yet another base insert constructed according to the concepts of the present invention.

In FIG. 14, the base insert has no polymer filled groove.

Cartridge cases may be made using base inserts having any combination of the features disclosed in herein.

In light of the foregoing, it should thus be evident that a base insert of the present invention, for use with a cartridge case, substantially improves the art. While, in accordance with the patent statutes, only the preferred embodiments of the present invention have been described in detail hereinabove, the present invention is not necessarily to be limited thereto or thereby. Rather, the scope of the invention shall include all modifications and variations that fall within the scope of the attached claims.

What is claimed is:

1. A base insert for a cartridge case comprising:

a base end having a lip and a groove proximate the lip and having a primer pocket defined in the base end;

an insert end having a base wall and a cylindrical wall extending there from, said base wall and cylindrical wall defining a powder fill pocket;

wherein said base wall has a flash hole disposed therein and an inner surface facing the powder fill pocket;

wherein said cylindrical wall has an inner surface intersecting with the inner surface of the base wall and an outer surface defining the outer circumference of the base insert;

wherein the intersection of said inner surface of the base wall and the inner surface of the cylindrical wall is curved, while the outer surface of the insert end is not curved; and wherein the base wall includes an annular flashhole cutoff pit disposed therein, wherein the flashhole cutoff pit has at least one surface that is substantially perpendicular to the inner surface of the base wall.

2. The base insert as claimed in claim 1, wherein the inner surface of the base wall is substantially orthogonal to the outer surface of the cylindrical wall, while the inner surface of the cylindrical wall is substantially slanted and not parallel to the cylindrical wall.

3. The base insert as claimed in claim 2, wherein the cylindrical wall has a tapering thickness, wherein the cylindrical wall is thicker proximate its intersection with the base wall and thinner distal from the base wall.

* * * * *